US007917065B2

(12) United States Patent
Aruga et al.

(10) Patent No.: US 7,917,065 B2
(45) Date of Patent: Mar. 29, 2011

(54) IMAGE FORMING APPARATUS THAT COLLECTS AND FILTERS EXCESS LIQUID DEVELOPER

(75) Inventors: Tomoe Aruga, Komogane (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/605,181

(22) Filed: Oct. 23, 2009

(65) Prior Publication Data

US 2010/0040395 A1 Feb. 18, 2010

Related U.S. Application Data

(63) Continuation of application No. 11/610,369, filed on Dec. 13, 2006, now Pat. No. 7,630,671.

(30) Foreign Application Priority Data

Dec. 20, 2005 (JP) ..... 2005-366165
Dec. 20, 2005 (JP) ..... 2005-366166
Dec. 20, 2005 (JP) ..... 2005-366167

(51) Int. Cl.
*G03G 15/10* (2006.01)

(52) U.S. Cl. ..... 399/237

(58) Field of Classification Search ..... 399/237, 399/249

See application file for complete search history.

(56) References Cited

U.S. PATENT DOCUMENTS 5,923,356 A 7/1999 Gibson et al. ..... 347/131
5,950,054 A * 9/1999 Kim ..... 399/237
6,289,192 B1 9/2001 Nukada et al. ..... 399/250
6,397,030 B1 * 5/2002 Watanabe ..... 399/237
6,496,676 B1 * 12/2002 Caruthers et al. ..... 399/296
7,260,344 B2 * 8/2007 Shin et al. ..... 399/237
7,599,650 B2 * 10/2009 Katoh et al. ..... 399/279
2005/0158082 A1 7/2005 Shin et al. ..... 399/237
2006/0210315 A1 * 9/2006 Nakamura et al. ..... 399/237
2007/0122181 A1 5/2007 Kamijo et al. ..... 399/101

FOREIGN PATENT DOCUMENTS

JP 08146695 A * 6/1996
JP 10177329 A * 6/1998
JP 11237827 A * 8/1999
JP 2002174967 A * 6/2002
JP 2002-189354 7/2002
JP 2002-296918 10/2002
JP 2003-107913 4/2003

OTHER PUBLICATIONS

Translation of JP2002-174967A to Iwai.*
Translation of JP2002-174967A to Iwai; Jun. 21, 2002 (attached to office action mailed May 21, 2010).*

* cited by examiner

*Primary Examiner* — Quana M Grainger
(74) *Attorney, Agent, or Firm* — DLA Piper LLP (US)

(57) ABSTRACT

A developing system comprises: a plurality of image carriers; a plurality of developing devices for developing electrostatic latent images, formed on the plurality of image carriers, with respective liquid developers of different colors of which carrier is nonvolatile solvent; and developer collecting means which are disposed at a plurality of locations for collecting excess developers, wherein the developing devices have developer containers, respectively. The developing system further comprises a carrier storing tank for distributing the carrier to the respective developer containers.

7 Claims, 3 Drawing Sheets

IMAGE FORMING APPARATUS THAT COLLECTS AND FILTERS EXCESS LIQUID DEVELOPER

CROSS-REFERENCE TO RELATED APPLICATIONS

This application is a continuation of application Ser. No. 11/610,369, filed on Dec. 13, 2006, the entire contents of which are incorporated herein by reference. This application also based on Japanese Patent Applications No. 2005-366165 filed Dec. 20, 2005, No. 2005-366166 filed Dec. 20, 2005, and No. 2005-366167 filed Dec. 20, 2005, the entire contents including specification, drawings, and abstracts of which are incorporated herein by reference.

BACKGROUND

1. Technical Field

The present invention relates to a developing system comprising a plurality of image carriers, a plurality of developing devices for developing electrostatic latent images formed on the plurality of image carriers with respective developers of different colors of which carrier is nonvolatile solvent, and a plurality of developer collecting means which are disposed at a plurality of positions to collect excess developers. The present invention also relates to an image forming apparatus using the aforementioned developing system and comprising an intermediate transfer member to which developed toner images are sequentially transferred at primary transfer sections corresponding to the plurality of image carriers and are superposed on each other and which carries and transports the superposed toner image, and an output device which transfers the superposed toner image at a secondary transfer section from the intermediate transfer member to a sheet on a feeding path and outputs the image.

2. Related Art

There have been proposed various wet-type image forming apparatuses capable of visualizing an electrostatic latent image by developing the latent image with a high viscosity liquid developer containing a liquid solvent and a toner as solid substance dispersed therein. The developer employed in the wet-type image forming apparatus is formed by suspending solid substance (toner particles) in an electrical insulating organic solvent (carrier liquid) such as silicone oil, mineral oil, or cooking oil. The toner particles are very fine, for example, of about 1 μm in particle diameter. By employing such fine toner particles, the wet-type image forming apparatus can form high quality images as compared to a dry-type image forming apparatus employing powder-type toner particles of about 7 μm in particle diameter.

The carrier liquid composing the developer has not only a function of preventing the toner particles of about 1 μm in particle diameter from scattering, but also a function of making the toner particles charged and making the toner particles uniformly dispersed, and also a function of facilitating the transfer of toner particles by electric field during development and transfer process. Though the carrier liquid is a necessary ingredient for the toner conservation, the toner transport, the development, and the transfer process as mentioned above, the carrier liquid adheres also to non-imaging regions and the excess carrier liquid after development may cause deterioration of transfer. Accordingly, such an operation is normally performed as to remove (squeeze) carrier liquid on the photoreceptor and the intermediate transfer member (see, for example, JP-A-2002-296918). In case of a wet-type image forming apparatus employing an intermediate transfer belt and further a secondary transfer belt, such a measurement for removing liquid developer (carrier and solid substance) adhering to the belt surfaces by cleaning blades is taken (see, for example, JP-A-2002-189354). As for recycling the developers, there have been proposed a recycling system comprising a plurality of developing devices which are disposed to selectively face a photoreceptor drum and a plurality of squeezing devices corresponding to the respective developing devices which are disposed downstream from the developing devices, wherein excess developers used for the development on the photoreceptor drum are squeezed by the squeezing devices and the excess developers collected by the squeezing devices are returned to the corresponding developing devices by circulating devices (see, for example, JP-A-2003-107913).

SUMMARY

In the aforementioned conventional recycling system for developers, excess developers used for the development on the photoreceptor drum are squeezed by the squeezing devices and the excess developers collected by the squeezing devices are just returned to the corresponding developing devices by the circulating devices.

By the way, in this system, the concentration of toner particles in the developing device is decreased when the toner density of the developed image formed by the image forming apparatus is high and the concentration of toner particles in the developing device is little decreased when the toner density of the developed image is low. That is, according to the kind of image to be formed by the image forming apparatus, the respective toner concentrations in the developing devices are changed every development. Therefore, it is naturally required to control the weight ratio of toner particles in the developer in each developing device to be substantially constant by detecting the weight ratio of dispersed toner particles in the developer by a detecting means for each developing device and adding a predetermined amount of developer and/or carrier from a developer cartridge and/or a carrier cartridge according to the result of detection by the detecting means. Since there must be a case where the amount of carrier is insufficient and a case where the amount of carrier is excessive, such a recycling system for developers capable of flexibly dealing with the both cases is needed.

However, the aforementioned conventional recycling system for developers is a system in which the excess developers are just collected and returned to the respective developing devices, i.e. that was made without taking the aforementioned matter into consideration.

Accordingly, the object of the present invention is to provide a structure capable of flexibly supplying carrier to developer containers to maintain the conditions of developers in the developer containers constant so as to achieve stable image formation.

According to an aspect of the invention, there is provided a developing system comprising: a plurality of image carriers; a plurality of developing devices for developing electrostatic latent images, formed on the plurality of image carriers, with respective liquid developers of different colors of which carrier is nonvolatile solvent; and developer collecting means which are disposed at a plurality of locations for collecting excess developers, wherein the developing devices have developer containers, respectively, the developing system further comprising a carrier storing tank for distributing the carrier to the respective developer containers.

According to another aspect of the invention, there is provided a developing system comprising: a plurality of image carriers; a plurality of developing devices for developing electrostatic latent images, formed on the plurality of image carriers, with respective liquid developers of different colors of which carrier is nonvolatile solvent; and developer collecting means which are disposed at a plurality of locations for collecting excess developers, wherein the developing devices have developer containers, respectively, the developing system further comprising carrier cartridges for supplying the carrier to the respective developer containers.

It is preferable that the developing system further comprises a plurality of developer cartridges for supplying highly concentrated liquid developers, of which toner ratios are higher than the toner ratios of the liquid developers in the developer containers, to the developer containers, respectively.

It is preferable that the developing system further comprises a carrier storing tank for supplying carrier to the carrier cartridges.

It is preferable that the carrier cartridge and the carrier storing tank are interchangeable with each other.

Further, it is preferable that the concentration of the liquid developer in each developer container is controlled by adjusting the amount of carrier to be supplied from the carrier cartridge to the developer container and/or adjusting the amount of high concentrated liquid developer to be supplied from the developer cartridge to the developer container.

Further, it is preferable that the concentration of the liquid developer in the developer container is controlled based on a concentration detecting means disposed on the developer container.

Further, it is preferable that the concentration of the liquid developer in the developer container is controlled based on a result of counting the number of dots of image to be outputted.

It is preferable that the developer collecting means include image carrier squeezing means, image carrier cleaning means, intermediate transfer member squeezing means, intermediate transfer member cleaning means, and secondary transfer roller cleaning means, wherein collected developers collected by the developer collecting means are merged into a same path and are collected into a buffer tank.

Further, it is preferable that carrier is distributed from the buffer tank to the plurality of developer containers.

Further, it is preferable that the carrier stored in the buffer tank is supplied to the developer containers prior to the carrier stored in the carrier storing tank.

Further, it is preferable that the buffer tank is provided with a toner concentration sensor.

According to another aspect of the invention, there is provided an image forming apparatus including a developing system which comprises: a plurality of image carriers; a plurality of developing devices for developing electrostatic latent images, formed on the plurality of image carriers, with respective liquid developers of different colors of which carrier is nonvolatile solvent; and developer collecting means which are disposed at a plurality of locations for collecting excess developers, wherein the developer collecting means include image carrier squeezing means, image carrier cleaning means, intermediate transfer member squeezing means, intermediate transfer member cleaning means, and secondary transfer roller cleaning means, wherein collected developers collected by the developer collecting means are merged into a same path and are collected into a buffer tank, and carrier is distributed from the buffer tank to the plurality of developer containers, said image forming apparatus further including an intermediate transfer member to which developed toner images are sequentially transferred at primary transfer sections corresponding to the plurality of image carriers and are superposed on each other and which carries and transports the superposed toner image, and secondary transfer means which transfers the superposed toner image at a secondary transfer section from the intermediate transfer member to a sheet on a feeding path.

It is preferable that the collected developers merged in the same path are collected in the buffer tank after passing through a filter means.

It is preferable that a single pump is disposed to suck the collected developers from the respective developer collecting means.

It is preferable that the buffer tank is provided with a toner concentration sensor.

Further, it is preferable that the buffer tank is set into a banning mode for banning the use of carrier from the buffer tank, a tank replacing mode for calling on user to replace the buffer tank, and/or a filter replacing mode for calling on user to replace the filter when the toner concentration sensor detects a concentration higher than a predetermined concentration.

The apparatus according to the invention has a structure capable of flexibly supplying carrier to developer containers. Specifically, developers are collected to a buffer tank from image carrier squeezing devices, image carrier cleaning devices, an intermediate transfer squeezing device, an intermediate transfer cleaning device, and a secondary transfer roller cleaning device and then carrier of the collected developers can be distributed from the buffer tank to a plurality of developer containers. Therefore, the toner weight ratios in the developer containers can be controlled to be constant, thereby achieving stable image formation.

DESCRIPTION OF EXEMPLARY EMBODIMENTS

Figure 1:
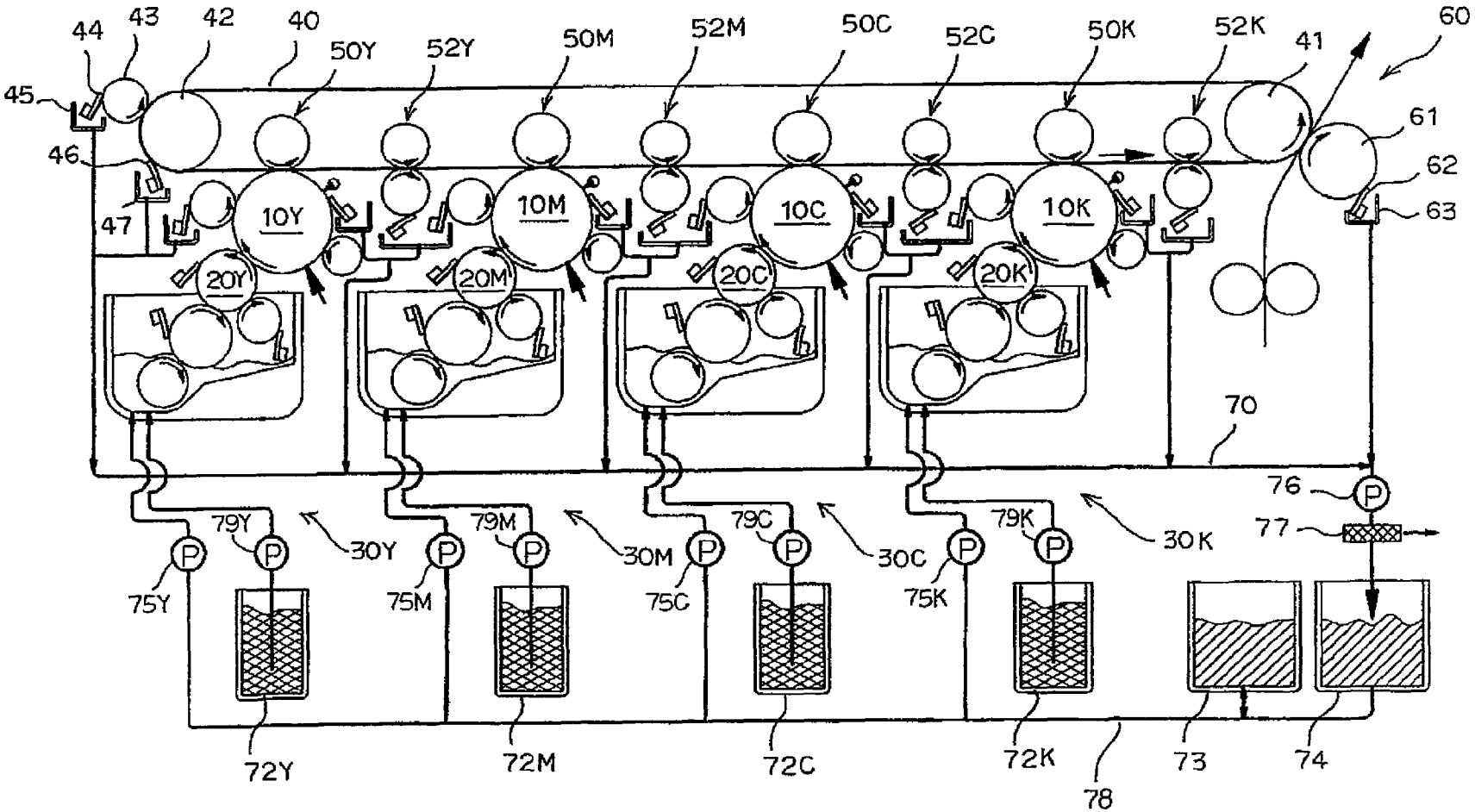
FIG. 1 is an illustration showing main components composing a developing system according to an embodiment of the invention.
Figure 2:
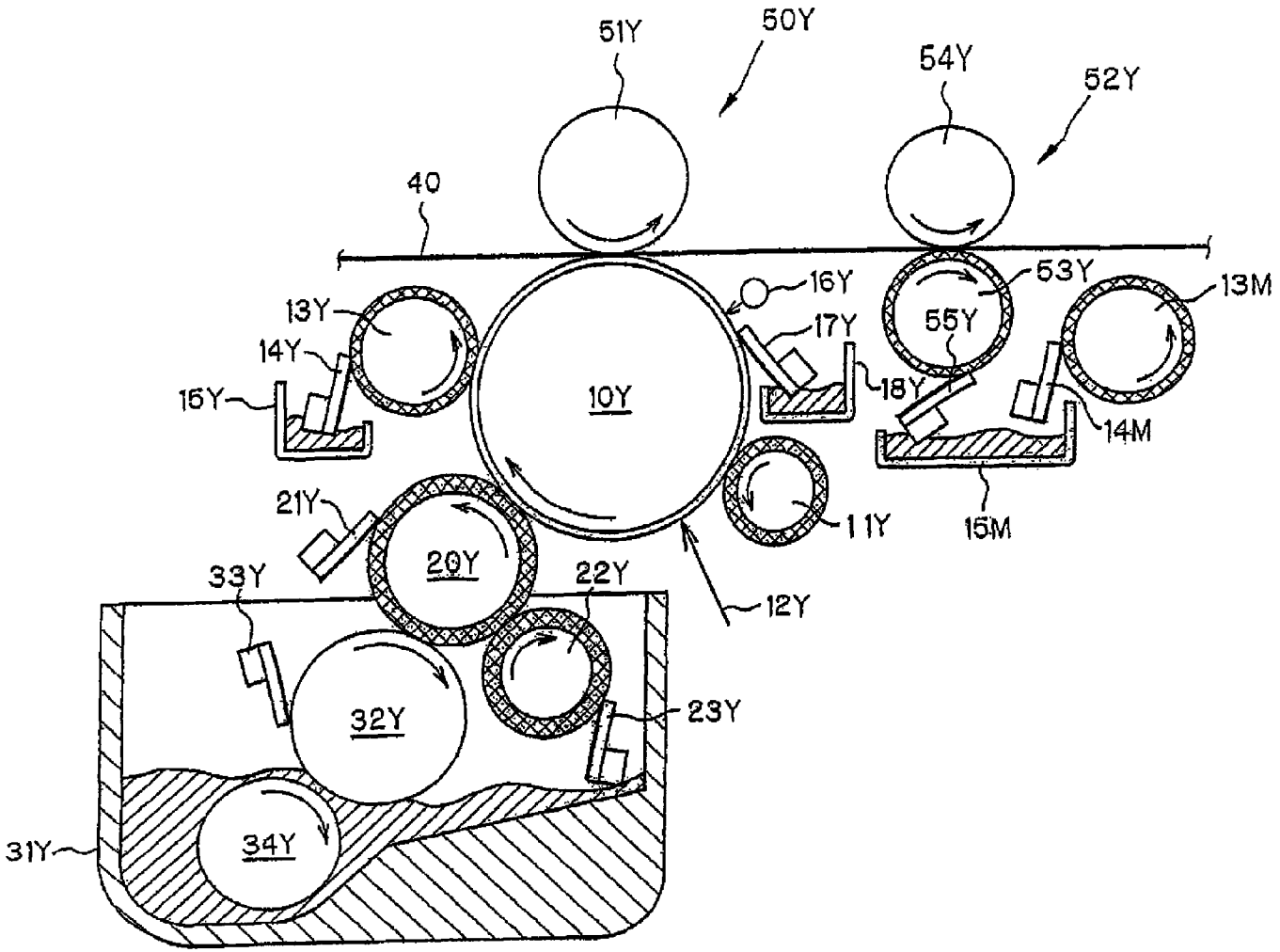
FIG. 2 is a sectional view showing main components of an image forming section, a developing unit, and an intermediate transfer member squeezing device.

Hereinafter, embodiments of the invention will be described with referred to the attached drawings. FIG. 1 is an illustration showing main components composing a developing system according to an embodiment of the invention and FIG. 2 is a sectional view showing main components of an image forming section, a developing unit, and an intermediate transfer member squeezing device. As for the mage forming sections, the developing units, and the intermediate transfer member squeezing devices for respective colors i.e. yellow (Y), magenta (M), cyan (C), and black (K), the same components for the respective colors are marked with the same numerals with respective marks Y, M, C, K for indicating the respective colors. Among these, the image forming section, the developing unit, and the intermediate transfer member squeezing device for yellow (Y) are shown in FIG. 2. Hereinafter, detail description about the image forming section, the developing unit, and the intermediate transfer member squeezing device will be described with reference to FIG. 2.

In the image forming section, a latent image eraser 16Y, a cleaning device for an image carrier composed of a cleaning blade 17Y and a developer collecting portion 18Y, a charging roller 11Y, an exposure unit 12Y, a development roller 20Y for a developing unit 30Y, and a cleaning device composed of an image carrier squeezing roller 13Y and accessories thereof, i.e. a cleaning blade 14Y and a developer collecting portion 15Y are arranged along the outer periphery of the image carrier 10Y in the rotation direction (moving direction). The developing unit 30Y comprises a cleaning blade 21Y, a developer supplying roller 32Y composed of an anilox roller and a regulating blade 33Y for regulating the amount of developer to be supplied by the developer supplying roller 32Y, and a developer compaction roller 22Y and a cleaning blade 23Y for scraping and removing the developer on the surface of the developer compaction roller 22Y which are arranged around the periphery of the development roller 20Y. The developing unit 30Y also comprises a developer container (reservoir) 31Y in which liquid developer is stored and a developer agitating roller 34Y which is disposed in the developer container 31Y for agitating the developer to uniformly disperse toner particles. Further, a primary transfer roller 51Y of a primary transfer section 50Y is disposed at a position facing the image carrier 10Y across the intermediate transfer member 40 and the intermediate transfer member squeezing device 52Y is disposed downstream of the primary transfer roller 51Y in the moving direction of the intermediate transfer member 40. Furthermore, the primary transfer sections 50 for the other colors (M, C, K) and the intermediate transfer member squeezing devices 52 for the other colors (M, C, K) are also disposed along the intermediate transfer member 40. The intermediate transfer member squeezing device 52Y comprises an intermediate transfer member squeezing roller 53Y, a backup roller 54Y, a cleaning blade 55Y for the intermediate transfer member squeezing roller, and a developer collecting portion 15M.

The liquid developer stored in the developer container 31Y is a nonvolatile liquid developer which has high concentration and high viscosity and has nonvolatility at ambient temperatures, not a volatile liquid developer of a conventionally generally used type of which carrier is Isopar (trademark: Exxon) and which has low concentration (about 1-2 wt %) and low viscosity and has volatility at ambient temperatures. That is, the liquid developer of the embodiment is a liquid developer having high viscosity (30-10000 mPa·s) of which concentration of toner solid substance is about 25% and which is prepared by adding solid substance having mean particle diameter of 1 μm containing a colorant such as pigment dispersed in a thermoplastic resin to a liquid solvent such as an organic solvent, silicone oil, mineral oil, or cooking oil together with a dispersant. The liquid developer stored in the developer container 31Y is maintained in a state containing 75% carrier and 25% toner substance by substantial weight ratio which are dispersed uniformly by adding developer, containing toner solid substance at a high concentration of about 35-55% by weight ratio, from a developer cartridge 72Y and/or carrier from a carrier storing tank 73 and a carrier buffer tank 74 according to the concentration of the developer which is changed every development to the image carrier, and by agitating them with the liquid developer agitating roller 34Y.

In the image forming section and the developing unit 30Y, the image carrier 10Y is uniformly charged by the charging roller 11Y. According to image signals inputted, the exposure unit 12Y having an optical system such as a semiconductor laser, a polygon mirror, or an F-θ lens radiates modulated laser beams onto the charged image carrier 10Y so as to form electrostatic latent image on the image carrier 10Y. Liquid developer of each color (here, yellow) is carried by the developer supplying roller 32Y from the developer container 31Y storing the liquid developer (yellow). After the supplying amount of the developer is regulated by the regulating blade 33Y, the liquid developer is supplied to the development roller 20Y from the developer supplying roller 32Y so as to develop the electrostatic latent image formed on the image carrier 10Y.

The intermediate transfer member 40 is an endless belt and is laid to extend around and between a driving roller 41 and a tension roller 42 with some tension and is driven to circle by the driving roller 41 such that the intermediate transfer member 40 is in contact with the image carriers 10Y, 10M, 10C, 10K at primary transfer sections 50Y, 50M, 50C, 50K. At the primary transfer sections 50Y, 50M, 50C, 50K, the primary transfer rollers 51Y, 51M, 51C, 51K are arranged to face the image carriers 10Y, 10M, 10C, 10K across the intermediate transfer member 40 such that the contact positions relative to the image carriers 10Y, 10M, 10C, 10K are transfer positions. The developed toner images of respective colors on the image carriers 10Y, 10M, 10C, 10K are transferred sequentially to the intermediate transfer member 40 and are superposed on each other, thereby forming a full-color toner image. The intermediate transfer member 40 carries the toner images, which are primarily transferred from the plurality of image carriers (photoreceptors) 10Y, 10M, 10C, 10K and are superposed on each other, and secondarily transfers the superposed image to a sheet medium at one time. Therefore, as for the intermediate transfer member 40, an elastic belt member is employed as a means for allowing the secondary transfer to a sheet medium even having an uneven surface because of fibers so as to improve the secondary transfer characteristics.

The secondary transfer unit 60 comprises a secondary transfer roller 61 which is arranged to face the belt driving roller 41 across the intermediate transfer member 40, and further a cleaning device. The cleaning device comprises a secondary transfer roller cleaning blade 62 and a developer collecting portion 63. At the transfer position, a single-color toner image or a full-color toner image formed by superposing colors on the intermediate transfer member 40 is secondarily transferred to a recording medium such as a paper, a film, or a cloth which is fed through a sheet carrying passage L in synchronization with the arrival of the toner image to the transfer section of the secondary transfer unit 60. In addition, a fixing unit (not shown) is disposed downstream of the secondary transfer unit 60 along the sheet carrying passage L and fuses the single toner image or the full-color toner image transferred to the recording medium (sheet medium) such as paper so that the single toner image or the full-color toner image is fixed to the recording medium. In this manner, the image formation onto the sheet medium as an end is finished. As for the secondary transfer roller 61, an elastic roller of which surface is coated by an elastic material is employed as a means for allowing the secondary transfer to a sheet medium even having an uneven surface because of fibers so as to improve the secondary transfer characteristics. This is the same purpose of the elastic belt member employed for the intermediate transfer member 40 which carries the toner images, primarily transferred from the plurality of image carriers 10Y, 10M, 10C, 10K and superposed on each other, and secondarily transfers the superposed image to a sheet medium at one time.

Arranged around the outer periphery of the tension roller 42 which cooperates with the belt driving roller 41 to support the intermediate transfer member 40 with some tension are a developer compaction roller 43, which is disposed to be in contact with the intermediate transfer member 40, and a cleaning device which comprises a cleaning blade 46 and a developer collecting portion 47 and which is located downstream of the developer compaction roller 43 in the moving direction of the intermediate transfer member 40. Also on the outer periphery of the developer compaction roller 43, a cleaning device which comprises a compaction roller cleaning blade 44 and a developer collecting portion 45 is disposed to face the developer compaction roller 43. Applied to the developer compaction roller 43 is a bias voltage of a polarity for pressing the toner remaining on the intermediate transfer member 40 to the intermediate transfer member 40 side. The intermediate transfer member 40 after passing the secondary transfer unit 60 moves to a portion winding the tension roller 42 where toner particles are pressed to the intermediate transfer member 40 side by the developer compaction roller 43 and the surface of the intermediate transfer member 40 is cleaned by the cleaning blade 46. Then, the intermediate transfer member 40 is again headed to the primary transfer sections 50.

In the developer container 31Y, the toner particles in the liquid developer have a positive charge. The liquid developer is agitated by the agitating roller 34Y so that it becomes into the uniformly dispersed state and is picked up from the developer container 31Y by the rotation of the developer supplying roller 32Y. After the amount of the developer is regulated by the regulating blade 33Y, the developer is supplied to the development roller 20Y. The developer stored in the developer container 31Y is initially in a state that about 25% toner is uniformly dispersed in carrier by substantial weight ratio. The consumption rate of toner component is high in case of development with high image duty in the development to the image carrier 10Y, while the consumption rate of toner component is low in case of development with low image duty. That is, the toner weight ratio in the developer stored in the developer container 31Y is changed every development to the image carrier 10Y so that it is required to always monitor the changes and to control the developer to be maintained to have a substantial toner weight ratio of about 25%.

For controlling the concentration of developer in the developer container 31Y, as a means for detecting the concentration, a transmissive photosensor (not shown) for detecting a weight ratio of dispersed toner particles or various detecting means such as a torque detecting means for detecting the agitating torque of the developer agitating roller 34Y and a reflective photosensor for detecting a liquid surface condition of developer in the developer container 31Y may be arranged on the developing unit 31Y. When the weight ratio of dispersed toner in a predetermined amount of developer becomes lower, a predetermined amount of developer having highly concentrated toner such as 35% to 55% toner weight ratio is added to the developer container 31Y from the developer cartridge 72Y. On the other hand, when the weight ratio of dispersed toner becomes higher, a predetermined amount of carrier is added to the developer container 31Y from the carrier storing tank 73 and the carrier buffer tank 74. By such addition, the substantial toner weight ratio is controlled to be about 25%.

The addition of a predetermined amount of carrier to the developer container 31Y from the carrier storing tank 73 and the carrier buffer tank 74 is adjusted by controlling the operation of a pump 75Y. The addition of a predetermined amount of developer, having highly concentrated toner such as 35 to 55% toner weight ratio, to the developer container 31Y from the developer cartridge 72Y is adjusted by controlling a pump 79Y.

By a controller (CPU) for controlling image signals, consumption of the developer is estimated from the number of dots of images to be outputted and, according to this estimation, the concentration of the developer in the developer container 31Y is estimated. According to this estimation, the amount of developer from the developer cartridge 72Y and/or the amount of carrier from the carrier storing tank 73 and the carrier buffer tank 74 can be predictively controlled. By this predictive control, the responsibility and reliability are improved.

In the developing system of this embodiment as mentioned above, according to the concentration of developer which is changed every development to the image carrier, developer having highly concentrated toner is added from the developer cartridge 72Y and carrier is added from the carrier storing tank 73 and the carrier buffer tank 74 so that the 25% toner is uniformly dispersed in 75% carrier by the substantial weight ratio. At the time of the secondary transfer to a sheet medium after various processes using this developer and immediately before the fixing process (not shown), it is desirable that the liquid developer has a substantial toner weight ratio of about 40% to 60% that is suitable for exhibiting the preferable secondary transfer function and fixing function. As so-called developer collecting means for removing and collecting excess developer and excess carrier, image carrier squeezing devices (13-15), image carrier cleaning devices (17, 18), intermediate transfer member squeezing devices (52-55), intermediate transfer member cleaning devices (42-47), and secondary transfer roller cleaning devices (62, 63) including cleaning blades as mentioned above are disposed at a plurality of suitable locations. These cleaning blades are, for example, the cleaning blade 14Y for the image carrier squeezing roller 13Y, the cleaning blade 17Y for the image carrier 10Y, the cleaning blade 55Y of the image transfer squeezing device 52Y, the cleaning blade 62 for the secondary transfer roller 61, the cleaning blade 44 for the developer compaction roller 43, and the cleaning blade 46 for the intermediate transfer member 40.

In this embodiment, for example, developer of the first color scraped by the cleaning blade 14Y and collected into the developer collecting portion 15Y, developer scraped by the cleaning blade 44 and collected into the developer collecting portion 45, and developer scraped by the cleaning blade 46 and collected into the developer collecting portion 47 are merged into a same path. Developer scraped by the cleaning blade 17Y and collected into the developer collecting portion 18Y, developer scraped by the cleaning blade 55Y and collected into the developer collecting portion 15M, and developer of the second color scraped by the cleaning blade 14M and collected into the developer collecting portion 15M are merged into a same path. Developers of the second color and later are merged into same paths in the same way. Then, developer of the fourth color scraped by the cleaning blade 17K and collected into the developer collecting portion 18K and developer scraped by the cleaning blade 55K and collected into the developer collecting portion 56K are merged into a same path. All of the merging paths as mentioned above and a path for developer scraped by the cleaning blade 62 and collected into the developer collecting portion 63 are incorporated into a developer collecting path 70 so that the developers passing through the respective paths and the developer collecting path are fed to a filter means 77 via a pump 76.

Carrier extracted by filtration of the filter means 77 is temporarily stored in the carrier buffer tank 74 and is then distributed to the plurality of developer containers 31. The carrier recycling ratios among the plurality of developer containers 31 are averaged, thereby enabling stable recycling of carrier. Since the developers are sucked from the respective developer collecting portions by the pump 76 and thus fed to the carrier buffer tank 74 via the filter means, it is not required to provide feeding means such as pumps for the respective developing units.

Developers scraped by the respective cleaning blades are filtered by passing the filter 77 from the collecting path 70, into which the respective paths are merged, and are stored in the carrier buffer tank 74 for recycling. As the developers used for the development are collected from the plurality of developing units, toner substances are mixed so that the colors are mixed. Since, therefore, the developers can not be recycled without any treatment, the filter means 77 is arranged on the feeding path for filtering toner particles from the developers so as to enable reuse of only carrier. For reusing the carrier, the carrier stored in the carrier buffer tank 74 is distributed to the developer container 31Y through a developer feeding path 78. The amount of carrier to be supplied to the developer container (reservoir) 31Y is controlled by the operation of the pump 75Y for the purpose of controlling the toner weight ratio in the developer container 31Y to be about 25% as mentioned above.

The filter means 77 is a means for filtering the developers, collected by the respective developer collecting means and merged into the collecting path, in such a manner as to separate toner solid substances and paper dust from carrier component. For example, a paper filter, an electrostatic filter, or another filter may be used. The carrier which is separated from the toner and thus now can be recycled is stored in the carrier buffer tank 74. The carrier temporarily stored in the carrier buffer tank 74 is distributed to the plurality of developer containers (reservoirs) 31 of the developing units, respectively, for recycling. According to this system, the recycling ratios of carrier are averaged, thereby enabling stable recycling. Therefore, the pump 76 for feeding the developers is a common member to all developing units as well as the filter means 77 and the feeding path, thereby achieving a simple and reasonable structure. Since developer collected from the cleaning devices of the secondary transfer roller 61 and the intermediate transfer member 40 may contain foreign matter and/or paper dusts, there is employed a way of disposing of such developer without being recycled. However, this embodiment employs a filtering process so as to separate both foreign matter and paper dusts, whereby developers collected from the respective portions can be recycled. The filtering function can be stably maintained by employing a system of replacing the filter of the filter means 77 with new one according to detection result of a detection means (not shown) for detecting the condition of the filter whether mixed toner substances, foreign matter, and the paper dusts are accumulated much or not.

The carrier buffer tank 74 is provided with a toner concentration sensor (not shown). Modes for stopping the reuse of the carrier from the carrier buffer tank 74 may be set when the toner concentration sensor detects a concentration exceeding the predetermined concentration. Examples as such modes include a banning mode in which the reuse of carrier from the carrier buffer tank 74 is banned, a tank replacing mode for calling on user to replace the carrier buffer tank 74, and a filter replacing mode for calling on user to replace the filter because the detection of the concentration exceeding the predetermined concentration by the toner concentration sensor is attributed to the fact that the condition of the filter is deteriorated.

In this embodiment, the carrier storing tank 73 is detachably disposed besides the carrier buffer tank 74, whereby the carrier storing tank 73 being full with carrier can be detached together with the carrier, and fresh carrier can be added from the carrier storing tank 73 when the required amount of carrier is larger than the amount of collected carrier. Accordingly, carrier can be promptly supplied from the carrier storing tank 73 when the carrier in the developing system is depleted, and the full carrier storing tank 73 can be replaced with another carrier storing tank which is empty and the full carrier storing tank 73 can be kept aside for future use, thereby enabling economical and efficient carrier reuse. In addition, it is not required to design the carrier buffer tank 74 to have large capacity, thereby resulting in reduction in size of the apparatus. The carrier storing tank 73 is adapted to supply carrier to the developer feeding path 78 and take up carrier from the developer feeding path 78 by means of a mechanism (not shown).

Carrier stored in the carrier storing tank 73 can also be distributed to the developer container (reservoir) 31Y through the developer feeding path 78. Carrier stored in the carrier storing tank 73 is also used for controlling the toner weight ratio in the developer container (reservoir) 31Y to be about 25%, similarly to the carrier stored in the carrier buffer tank 74.

The carrier stored in one of the carrier storing tank 73 and the carrier buffer tank 74 is adapted to be consumed prior to the carrier stored in the other one, thereby facilitating the management of carrier. For example, when the carrier stored in the carrier buffer tank 74 is adapted to be consumed prior to the carrier stored in the carrier storing tank 73, such a mode that the collected carrier is preferentially consumed and the fresh carrier stored in the carrier storing tank 73 is preserved can be taken.

The carrier component must be insufficient when the toner weight ratio of the developer supplied from the developer cartridge 72Y is high. On the other hand, the carrier component must be redundant when the toner weight ratio of the developer supplied from the developer cartridge 72Y is low. According to the embodiment, the carrier storing tank 73 is designed to be replaceable with new one relative to the carrier feeding path as well as the developer cartridge 72Y, whereby supplementation of carrier component can be easily carried out when the carrier component is insufficient. Not only when the toner weight ratio is low but also when development with high image duty is conducted, the toner weight ratio is increased to about 40% to 60% at the time of the secondary transfer or the fixing process with adding developer having about 35% to 55% toner weight ratio from the developer cartridge 72Y according to consumption of developer. Accordingly, the amount of carrier to be collected is increased so that the carrier component must be redundant. Since the developer cartridge 72Y stores developer having about 35% to 55% toner weight ratio, the amount of carrier to be collected is increased and becomes redundant according to the consumption of developer for development of high image duty. According to the embodiment, the carrier storing tank 73 is detachably disposed besides the carrier buffer tank 74, whereby the carrier storing tank 73 being full with carrier can be detached together with the carrier when the carrier component is redundant. Accordingly, the full carrier storing tank can be replaced with an empty carrier storing tank and can be kept aside for future use, thereby enabling economical and efficient carrier reuse. In addition, it is not required to design the carrier buffer tank 74 to have large capacity, thereby resulting in reduction in size of the apparatus.

Figure 3:
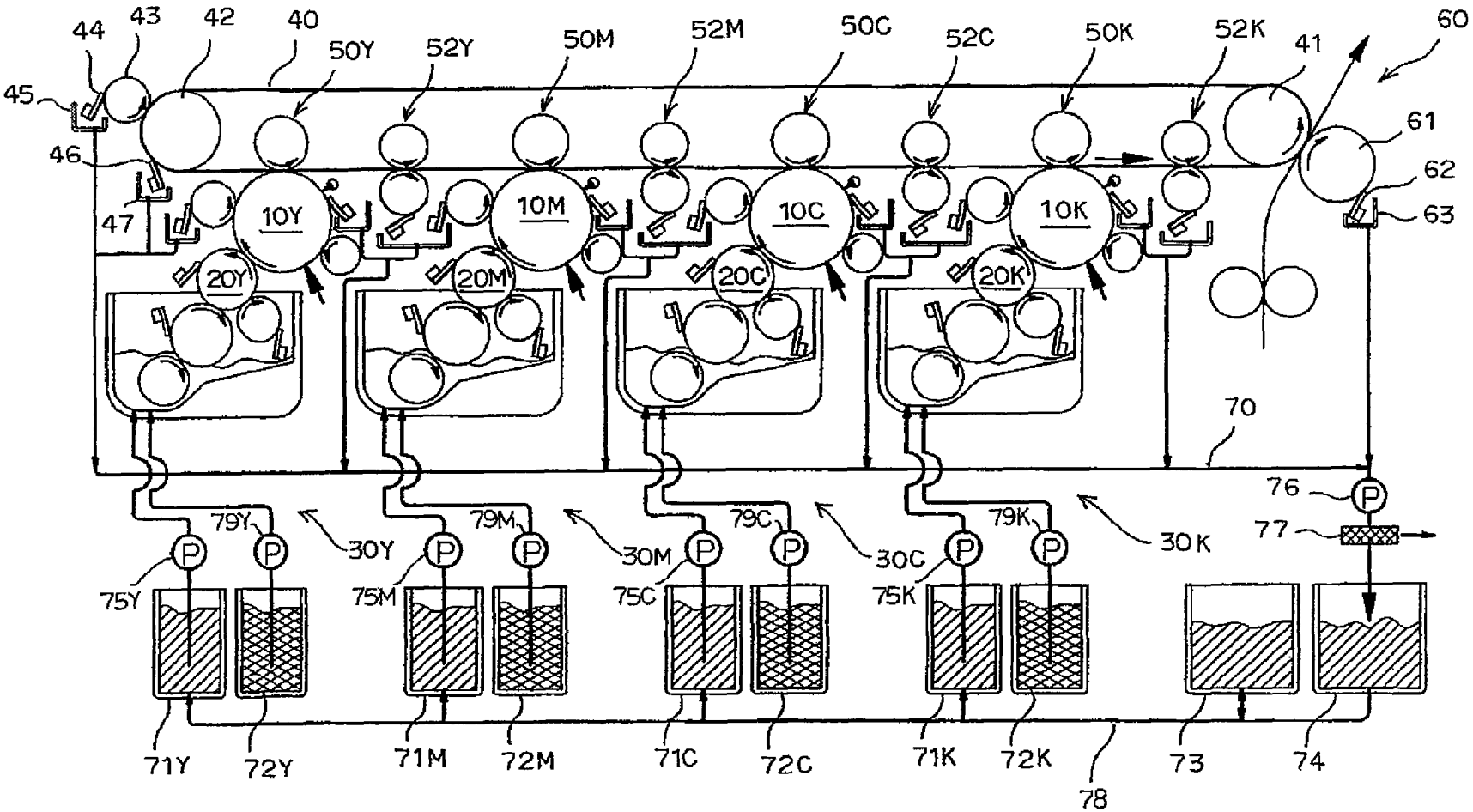
FIG. 3 is an illustration showing main components composing a developing system, provided with carrier cartridges, according to another embodiment of the invention.

Hereinafter, an embodiment in which carrier cartridges 71 are disposed upstream of developer container 31 will be described with reference to FIG. 3. FIG. 3 is an illustration showing main components composing a developing system, provided with carrier cartridges, according to the embodiment of the invention. As shown in FIG. 3, a carrier cartridge 71Y is disposed upstream of developer container 31Y via a pump 75Y. The carrier cartridge 71Y is adapted to receive the supply of carrier from the carrier storing tank 73 and the carrier buffer tank 74 via the developer carrying path 78. In this embodiment, respective developer collecting devices, a pump 76, a filter 77, a carrier storing tank 73, a carrier buffer tank 74, and the like are the same as those in the aforementioned embodiment.

As for the liquid developer stored in the developer container 31Y, according to the concentration of developer which is changed every development to the image carrier, developer having highly concentrated toner about 35% to 55% by the toner weight ratio is added from the developer cartridge 72Y and carrier is added from the carrier cartridge 71Y into the developer container 31Y so that the 25% toner is uniformly dispersed in 75% carrier by the substantial weight ratio by agitation operation of the liquid developer agitating roller 34Y. At the time of the secondary transfer to a sheet medium after various processes using this developer and immediately before the fixing process (not shown), it is desirable that the liquid developer has a substantial toner weight ratio of about 40% to 60% that is suitable for exhibiting the preferable secondary transfer function and fixing function.

The addition of a predetermined amount of carrier to the developer container 31Y from the carrier cartridge 71Y is adjusted by controlling the operation of a pump 75Y. The addition of a predetermined amount of developer, having highly concentrated toner such as 35 to 55% toner weight ratio, to the developer container 31Y from the developer cartridge 72Y is adjusted by controlling a pump 79Y.

For controlling the concentration of developer in the developer container 31Y, as a means for detecting the concentration, a transmissive photosensor (not shown) for detecting a weight ratio of dispersed toner particles or various detecting means such as a torque detecting means for detecting the agitating torque of the developer agitating roller 34Y and a reflective photosensor for detecting a liquid surface condition of developer in the developer container 31Y may be arranged on the developing unit 31Y. When the weight ratio of dispersed toner in a predetermined amount of developer becomes lower, a predetermined amount of developer having highly concentrated toner such as 35% to 55% toner weight ratio is added to the developer container 31Y from the developer cartridge 72Y. On the other hand, when the weight ratio of dispersed toner becomes higher, a predetermined amount of carrier is added to the developer container 31Y from the carrier cartridge 71Y. By such addition, the substantial toner weight ratio is controlled to be about 25%. By a controller (CPU) for controlling image signals, consumption of the developer is estimated from the number of dots of images to be outputted and, according to this estimation, the concentration of the developer in the developer container 31Y is estimated. According to this estimation, the amount of developer from the developer cartridge 72Y and/or the amount of carrier from the carrier cartridge 71Y can be predictively controlled. By this predictive control, the responsibility and reliability are improved.

Carrier stored in the carrier storing tank 73 and the carrier buffer tank 74 is distributed to the carrier cartridge 71Y through the developer feeding path 78 in association with the addition of developer from the developer cartridge 72Y to the developer container (reservoir) 31Y and the addition of carrier from the carrier cartridge 71Y to the developer containers (reservoirs) 31.

In case of using the carrier cartridge 71Y, the carrier cartridge 71Y is designed to be detachable relative to the carrier feeding path as well as the developer cartridge 72Y and the carrier cartridge 71Y is designed to be interchangeable with the carrier storing tank 73, whereby the carrier cartridge 71Y which became empty can be used as the carrier storing tank 73 directly, thereby increasing the convenience. Though the carrier may be allowed to flow bi-directionally between the carrier cartridge 71Y or the carrier storing tank 73 and the carrier feeding path, a check valve function is preferably provided to block the outward flow, thereby facilitating the detaching operation.

The developer may be mixed in a mixing bottle which is disposed separately from the developing unit and then supplied to the developer container 31Y. However, to prevent time lag from being created in control for corresponding to the concentration of developer in the developer container 31Y which varies each development, a suitable measurement should be taken. In this embodiment, the developer having high concentration of dispersed toner and the carrier are added to the developer container 31Y according to the detection result of the detection means for detecting the weight ratio of dispersed toner substance and the detection means for detecting the amount of developer in the developing unit, and are agitated for uniform mixing, thereby achieving the stable concentration control without time lag.

As mentioned above, according to the embodiment, the cleaning devices having developer collecting means are provided for scraping and collecting the developer which is then distributed to the developer container 31Y and is recycled. Now, the respective developer collecting means will be described. The developing unit 30Y has a cleaning blade 23Y for cleaning the developer compaction roller 22Y for compacting toner particles in the liquid developer on the development roller 20Y and a cleaning blade 21Y for cleaning the development roller 20Y. The cleaning blade 21Y is disposed downstream in the rotation direction of the development roller 20Y from the development nip portion where the development roller 20Y is in contact with the image carrier 10Y, so as to scrape the developer remaining on the development roller 20Y. The cleaning blade 23Y scrapes the developer on the developer compaction roller 22Y according to the rotation thereof in a direction of an arrow in the drawings, and returns the developer to be merged into the developer in the reservoir 31Y so that the developer is recycled. The carrier and toner particles in the developer to be merged are not mixed with those for other colors.

The image carrier squeezing device is disposed to face the image carrier 10Y at a position downstream of the development roller 20Y in the rotation direction of the image carrier 10Y and comprises an image carrier squeezing roller 13Y, a cleaning blade 14Y which is pressed against the image carrier squeezing roller 13Y to clean the surface of the image carrier squeezing roller 13Y, and a developer collecting portion 15Y. The image carrier squeezing device has a function of collecting excess carrier and undesired fog toner from the developer used for the development on the image carrier 10Y so as to increase the ratio of toner particles in the developed image. In this embodiment, the image carrier squeezing roller 13Y is adapted to rotate together with the image carrier 10Y at substantially the same peripheral velocity so as to collect excess carrier having about 5%-10% toner weight ratio from the developer used for the development on the image carrier, thereby easing the driving load of rotation of both the image carrier 10Y and the image carrier squeezing roller 13Y and suppressing disturbance influence to the developed toner image on the image carrier 10Y. The excess carrier and undesired fog toner collected by the image carrier squeezing roller 13Y are collected from the image carrier squeezing roller 13Y and pooled in the developer collecting portion 15Y by the action of the cleaning blade 14Y. It should be noted that the excess carrier and the fog toner never become of mixed color because these are collected from the exclusive and separate image carrier 10Y.

At the primary transfer section 50Y, the developed image on the image carrier 10Y is transferred to the intermediate transfer member 40 by the primary transfer roller 51Y. The image carrier 10Y and the intermediate transfer member 40 are adapted to move at the same velocity, thereby easing the driving load for rotation and movement and suppressing disturbance influence to the developed toner image on the image carrier 10Y. Color mixing phenomenon does not occur at the primary transfer section 50Y for the first color because of the first time primary transfer. However, as for the second color or later, another toner image is transferred to and superposed onto the toner image portion which was primarily transferred so that so-called reverse transfer phenomenon that toner is transferred from the intermediate transfer member 40 to the image carrier 10(M, C, K) occurs and the color mixing phenomenon occurs between reverse-transferred toner and remaining toner after transfer. The reverse-transferred toner and the remaining toner after transfer are carried and conveyed by the image carrier 10(M, C, K) together with the excess carrier, and are collected from the image carrier by the action of the cleaning blade 17(M, C, K) and are pooled.

For exhibiting the preferable secondary transfer function and fixing function at the time of immediately before the fixing process (not shown) after the secondary transfer to a sheet medium as the final stage, the preferable toner weight ratio (the preferable amount of toner dispersed in carrier) of the developer is about from 40% to 60% as mentioned above. The intermediate transfer squeezing device 52Y is a means for further removing excess carrier from the intermediate transfer member 40 when the developer is not in the aforementioned preferable dispersed state at the final stage. The intermediate transfer member squeezing device 52Y is disposed downstream of the primary transfer section 50Y in the moving direction of the intermediate transfer member 40. The intermediate transfer member squeezing device 52Y comprises an intermediate transfer member squeezing roller 53Y, a backup roller 54Y disposed to face the intermediate transfer squeezing roller 53Y across the intermediate transfer member 40, a cleaning blade 55Y which is pressed against the intermediate transfer member squeezing roller 53Y to clean the surface of the intermediate transfer member squeezing roller 53Y, and a developer collecting portion 15M and has a function of removing excess carrier from the intermediate transfer member 40 so as to increase the ratio of toner particles in the developed image and also a function of collecting undesired fog toner. The developer collecting portion 15M is a component for storing carrier collected by a cleaning blade 14M for an image carrier squeezing roller for magenta which is disposed downstream of the intermediate transfer squeezing device 52Y in the moving direction of the intermediate transfer member 40, but also used for the cleaning blade 55Y for the intermediate transfer member squeezing roller 53Y. In this manner, the developer collecting portions 15 (M, C, K) of the image carrier squeezing devices of the second color and later are used also as the developer collecting portions for the intermediate transfer member squeezing devices 52 (Y, M, C) of the previous colors which are disposed downstream of the primary transfer sections 50 (Y, M, C) in the moving direction of the intermediate transfer member 40, thereby regulating the distances therebetween constant, and simplifying the structure and reducing the size of the apparatus.

Color mixing phenomenon does not occur at the intermediate transfer member squeezing section for the first color because of the first time intermediate transfer member squeezing. However, as for the second color or later, another toner image is transferred to and superposed onto the toner image portion which was primarily transferred so that the toner transferred from the intermediate transfer member 40 to the intermediate transfer squeezing roller 53Y is of mixed color and is carried and conveyed by the intermediate transfer member squeezing roller 53Y together with the excess carrier and collected from the intermediate transfer roller squeezing roller 53Y by the action of the cleaning blade. When the squeezing capacity by the image carrier 10Y at the primary transfer section upstream relative to the intermediate transfer member squeezing process and the squeezing capacity by the intermediate transfer member squeezing roller 53Y are sufficient, the intermediate transfer member squeezing device downstream of each primary transfer section is not always needed.

In synchronization with the arrival of the toner image of mixed color on the intermediate transfer member 40 to the secondary transfer section, the sheet medium is fed so that the toner image is secondarily transferred to the sheet medium. By conveying the toner image on the sheet medium to the fixing process, final image formation on the sheet medium is finished. When a sheet feeding trouble such as jam arises, not all of the toner image is secondarily transferred to the secondary transfer roller and collected so that a part of the toner image remains on the intermediate transfer member. Even in the normal secondary transfer process, not 100% of the toner image on the intermediate transfer member 40 is secondarily transferred to a sheet medium, thus causing residual toner as of several percentages of the toner image after secondary transfer. Particularly when a sheet feeding trouble such as jam arises, the toner image comes in contact with the secondary transfer roller 61 without sheet medium therebetween and is thus transferred to the secondary transfer roller 61, thus causing contamination of the reverse side of sheet medium. To remove the undesired toner image, a bias voltage in a direction of pressing toner particles of the liquid developer to the intermediate transfer member 40 side, that is, a bias voltage of the same polarity of the charging polarity of toner particles is applied to the developer compression roller 43. The bias voltage may be applied to the secondary transfer roller 61 or the intermediate transfer member squeezing roller 53Y. Accordingly, toner particles in the liquid developer remaining on the intermediate transfer member 40 are pressed to the intermediate transfer member 40 side so that the toner particles become into the compaction state and the carrier liquid is collected (squeezed) to the secondary transfer roller 61, thereby efficiently cleaning the surface of the intermediate transfer member 40 by the cleaning blade 46 and efficiently cleaning the surface of the secondary transfer roller 61 by the cleaning blade 62. The cleaning blade 62 for the secondary transfer roller is disposed as a means of removing developer (toner particles dispersed in carrier) transferred to the secondary transfer roller 61 and collecting the developer from the secondary transfer roller 61 so that the developer is pooled. Though the developer thus collected is of mixed color and may contain foreign matter such as paper dusts, the developer is filtered to separate them by the filter 77 as mentioned above.

What is claimed is:

1. An image forming apparatus comprising:

an image carrier on which an electrostatic latent image is formed, a developing device that develops the electrostatic latent image by means of liquid developer that contains toner and nonvolatile carrier, a developer container that stores the liquid developer, an intermediate transfer member to which a developed image on the image carrier is transferred, an image carrier cleaner that removes the liquid developer on the image carrier, a secondary transfer roller that transfers the developed image from the intermediate transfer member to a sheet, an intermediate transfer member cleaner that removes the liquid developer on the intermediate transfer member, a developer collecting path that collects the liquid developer removed by the image carrier cleaner and the intermediate transfer member cleaner, a filter located within the developer collecting path that filters the collected liquid developer to separate the toner from the carrier, a buffer tank that stores carrier filtered by the filter, a carrier storing tank that stores carrier and that supplies carrier to the developer container, a developer feeding path that distributes the carrier stored in the buffer tank or the carrier stored in the carrier storing tank to the developer container, and a controller that controls the supply of the carrier stored in the buffer tank and/or the carrier stored in the carrier storing tank to the developer container.

2. An image forming apparatus as claimed in claim 1, wherein carrier stored in the carrier storing tank and carrier stored in the buffer tank are distributed by the developer feeding path, and carrier stored in the buffer tank is adapted to be consumed prior to carrier stored in the carrier storing tank.

3. An image forming apparatus as claimed in claim 1, further comprising:

a secondary transfer roller cleaner that removes the liquid developer on the secondary transfer roller, wherein liquid developer collected by the secondary transfer roller cleaner is merged into the developer collecting path, and carrier obtained through filtering the liquid developer collected by the secondary transfer roller cleaner is stored in the buffer tank.

4. An image forming apparatus as claimed in claim 1, further comprising:

a second image carrier on which an electrostatic latent image is formed, a second developing device that develops the electrostatic latent image on the second image carrier by means of liquid developer of different color to liquid developer that stores the developer container, a second developer container that stores liquid developer of different color to liquid developer that stores the developer container, a second image carrier cleaner that removes the liquid developer on the second image carrier, wherein liquid developer collected by the second image carrier cleaner is merged into the developer collecting path, and carrier obtained through filtering the liquid developer collected by the second image carrier cleaner is stored in the buffer tank.

5. An image forming apparatus as claimed in claim 1, further comprising:

an image carrier squeezing roller that squeezes excess liquid developer used for developing the electrostatic latent image on the image carrier, wherein liquid developer collected by the image carrier squeezing roller is merged into the developer collecting path, and carrier obtained through filtering the liquid developer collected by the image carrier squeezing roller is stored in the buffer tank.

6. An image forming apparatus as claimed in claim 1, further comprising:

a developer compaction roller that is disposed to be in contact with the intermediate member, a developer compaction roller cleaner that removes the liquid developer on the developer compaction roller, wherein liquid developer collected by the developer compaction roller cleaner is merged into the developer collecting path, and carrier obtained through filtering the liquid developer collected by the developer compaction roller cleaner is stored in the buffer tank.

7. An image forming apparatus comprising:

an image carrier on which an electrostatic latent image is formed, a developing device that develops the electrostatic latent image by means of liquid developer that contains toner and nonvolatile carrier, a developer container that stores the liquid developer, an image carrier cleaner that removes the liquid developer on the image carrier, a secondary transfer roller that transfers the developed image to a sheet, a developer collecting path that collects the liquid developer removed by the image carrier cleaner, a filter located within the developer collecting path that filters the collected liquid developer to separate the toner from the carrier, a buffer tank that stores carrier filtered by the filter, a carrier storing tank that stores carrier and that supplies carrier to the developer container, a developer feeding path that distributes the carrier stored in the buffer tank or the carrier stored in the carrier storing tank to the developer container, and a controller that controls the supply of the carrier stored in the buffer tank and/or the carrier stored in the carrier storing tank to the developer container.

* * * * *